US011029013B2

(12) United States Patent
Zhang et al.

(10) Patent No.: US 11,029,013 B2
(45) Date of Patent: Jun. 8, 2021

(54) COMBINED LAMP AND ILLUMINATION SYSTEM

(71) Applicant: OPPLE LIGHTING CO., LTD., Shanghai (CN)

(72) Inventors: Zhenghua Zhang, Shanghai (CN); Jun Wu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/915,469

(22) Filed: Jun. 29, 2020

(65) Prior Publication Data

US 2020/0332992 A1 Oct. 22, 2020

Related U.S. Application Data

(63) Continuation of application No. PCT/CN2018/123932, filed on Dec. 26, 2018.

(30) Foreign Application Priority Data

Dec. 29, 2017 (CN) ..... 201711484926.2
Dec. 29, 2017 (CN) ..... 201721917952.5

(51) Int. Cl.
*F21V 23/06* (2006.01)
*F21S 2/00* (2016.01)
(Continued)

(52) U.S. Cl.
CPC ..... *F21V 23/06* (2013.01); *F21S 2/005* (2013.01); *F21V 3/02* (2013.01); *F21V 23/008* (2013.01);
(Continued)

(58) Field of Classification Search
None
See application file for complete search history.

(56) References Cited

U.S. PATENT DOCUMENTS

2012/0235579 A1* 9/2012 Chemel ..... F21V 21/15 315/152
2013/0122724 A1 5/2013 Velazquez
(Continued)

FOREIGN PATENT DOCUMENTS

CN 103648335 A 3/2014
CN 206617770 U 11/2017
(Continued)

OTHER PUBLICATIONS

International Search Report of PCT Application No. PCT/CN2018/123932 dated Mar. 15, 2019, (6p).

*Primary Examiner* — Elmito Breval
(74) *Attorney, Agent, or Firm* — Arch & Lake LLP

(57) ABSTRACT

Examples of the present disclosure provide an assembled lamp and a lighting system. A first conductive terminal is disposed on at least one of side walls of a lamp in the assembled lamp, a row hole of a second conduction terminal is disposed on other side walls, a power supply bus, a light source device and a processor connected with the power supply bus, and a communication bus connected with the processor are arranged inside the lamp, and each of the power supply bus and the communication bus is connected with the first conductive terminal and the second conductive terminal, while the first conductive terminal and the second conductive terminal in the row hole are in inserted connection, mechanical connection, electrical connection and communication connection between any two lamps are implemented. Thus, the solution of the present disclosure can make the operations for mechanical connection, electrical connection and communication connection between lamps simple, and save the complex step for arranging a plurality of wires between the lamps.

19 Claims, 6 Drawing Sheets

(51) Int. Cl.

| | |
|---|---|
| ***F21V 3/02*** | (2006.01) |
| ***F21V 23/00*** | (2015.01) |
| ***F21V 23/02*** | (2006.01) |
| ***F21V 23/04*** | (2006.01) |
| *F21S 8/00* | (2006.01) |
| *F21S 8/04* | (2006.01) |

(52) U.S. Cl.
CPC ..... *F21V 23/02* (2013.01); *F21V 23/0485* (2013.01); *F21S 8/03* (2013.01); *F21S 8/04* (2013.01)

(56) References Cited

U.S. PATENT DOCUMENTS

| | | | | |
|---|---|---|---|---|
| 2013/0322082 | A1 | 12/2013 | Hollander | |
| 2014/0049956 | A1* | 2/2014 | Manahan | F21V 23/04 362/233 |
| 2014/0125232 | A1 | 5/2014 | Griffiths et al. | |
| 2014/0167617 | A1 | 6/2014 | Poliquin et al. | |
| 2015/0035437 | A1* | 2/2015 | Panopoulos | F21V 14/02 315/112 |
| 2015/0267907 | A1 | 9/2015 | Thompson et al. | |
| 2015/0345765 | A1 | 12/2015 | Horst et al. | |
| 2017/0276332 | A1 | 9/2017 | Pearson et al. | |
| 2018/0324924 | A1* | 11/2018 | Van De Sluis | F21V 23/0442 |

FOREIGN PATENT DOCUMENTS

| | | | |
|---|---|---|---|
| CN | 107990221 | A | 5/2018 |
| CN | 207762689 | U | 8/2018 |
| EP | 1139008 | A2 | 10/2001 |
| EP | 1433997 | A2 | 6/2004 |
| EP | 2055849 | A1 | 5/2009 |
| WO | 2011028773 | A1 | 3/2011 |
| WO | 2011139764 | A2 | 11/2011 |

* cited by examiner

COMBINED LAMP AND ILLUMINATION SYSTEM

CROSS-REFERENCE

The present application is based on and claims priority to PCT Patent Application No. PCT/CN2018/123932 filed on Dec. 26, 2018 which claims priority of the Chinese Patent Application No. 201711484926.2, filed on Dec. 29, 2017, and Chinese Patent Application No. 201721917952.5, filed on Dec. 29, 2017, the entire disclosure of which are incorporated herein by reference as part of the present application for all purposes.

TECHNICAL FIELD

Examples of the present disclosure relate to a technical field of lighting, and particularly, to an assembled lamp or combined lamp and a lighting system.

BACKGROUND

An assembled lamp is more and more favored by most users due to advantages of flexible assembled shape, controllability of the color of one single module, collaborative color change of multiple modules which can be controlled to be continuously spliced and the like. Therefore, as a novel lamp, the assembled lamp has a flexible application mode and a wide market space, and the assembled lamp may be installed on the ceiling or the wall of a room, so as to promote the style of home lighting or commercial lighting.

However, the assembling mode and the wiring mode of the current assembled lamp are relatively complex, which not only wastes line resources, but also increases assembling time cost of the assembled lamp, so that cost of the assembled lamp is increased and it is not beneficial to widespread application of the assembled lamp.

SUMMARY

In view of the above problems, the present disclosure is proposed in order to provide an assembled lamp and a lighting system which overcome the above problems or at least partially solve the above problems.

According to an aspect of the present disclosure, an assembled lamp is provided, the assembled lamp comprises at least two lamps sequentially connected, each of the at least two lamp has a plurality of side walls, a first conductive terminal is arranged on at least one of the plurality of side walls, a row hole corresponding to the first conductive terminal is disposed on other side wall of the plurality of side walls, and a second conductive terminal is arranged in the row hole; a power supply bus, a light source device and a processor which are connected with the power supply bus, and a communication bus connected with the processor are arranged inside the lamp, and each of the power supply bus and the communication bus is connected with the first conductive terminal and the second conductive terminal of the lamp; in the assembled lamp, two adjacent lamps respectively are a first lamp and a second lamp, wherein the first conductive terminal of the first lamp is inserted into the row hole of the second lamp and connected with the second conductive terminal in the row hole so as to implement electrical connection and communication connection between the two adjacent lamps; the power supply bus of the first lamp receives an external voltage signal, supplies power to the processor and the light source device inside, and transmits the external voltage signal to the power supply bus of the second lamp via the conductive terminal in inserted connection with the first lamp; and the communication bus of the first lamp receives a control signal from an external main controller, and transmits the control signal onto the communication bus of the second lamp via the conductive terminal in inserted connection with the first lamp.

According to the other aspect of the present disclosure, a lighting system is provided, the lighting system comprises: a main controller and the assembled lamp connected with the main controller according to any one of examples mentioned above, a first conductive terminal or a row hole in which a second conductive terminal is arranged is arranged at any one end of the main controller, the main controller internally includes a control module for generating a control signal and a communication bus and a power supply bus which are respectively connected with the control module, and each of the power supply bus and the communication bus is connected with the first conductive terminal or the second conductive terminal on the main controller; the first conductive terminal of the main controller is inserted into the row hole of any one of the lamps and connected with the second conductive terminal in the row hole; or the first conductive terminal of any one of the lamps is inserted into the row hole of the main controller and connected with the second conductive terminal in the row hole, so as to implement mechanical connection, electrical connection and communication connection between the main controller and the assembled lamp; the power supply bus of the main controller receives an external voltage signal, supplies power to the control module inside, transmits the external voltage signal to a power supply bus of each of the lamps in the assembled lamp via the conductive terminal in inserted connection with the main controller, and supplies power to the processor and the light source device inside each of the lamps; and the control module of the main controller generates a control signal and transmits the control signal onto the communication bus of each of the lamps in the assembled lamp via the conductive terminal in inserted connection with the main controller, and the processor of at least one of the lamps controls a light-emitting state of the light source device inside of the lamp by utilizing the control signal on the communication bus.

According to the following detailed description of specific examples of the present disclosure in conjunction with the accompanying drawings, those skilled in the art will understand more about the above and other objects, advantages and features of the present disclosure.

BRIEF DESCRIPTION OF THE DRAWINGS

The drawings described herein are used to provide a further understanding of the present disclosure and constitute a part of the present disclosure. The schematic examples of the present disclosure and their descriptions are used to explain the present disclosure and do not constitute an improper limitation on the present invention. In the picture.

DETAILED DESCRIPTION

Figure 1:
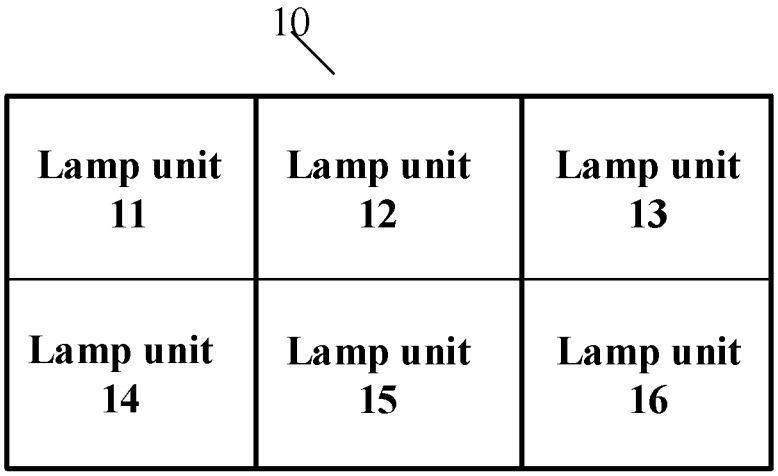
FIG. 1 shows a structural schematic diagram of an assembled lamp according to one example of the present disclosure.

Hereinafter, exemplary embodiments of the present disclosure will be described in more detail with reference to the accompanying drawings. Although exemplary embodiments of the present disclosure are shown in the drawings, it should be understood that the present disclosure should not be limited by the embodiments set forth herein and can be implemented in various forms. Rather, these embodiments are provided to enable the present disclosure to be understood more thoroughly and to fully convey the scope of the present disclosure to those skilled in the art.

Figure 2A:
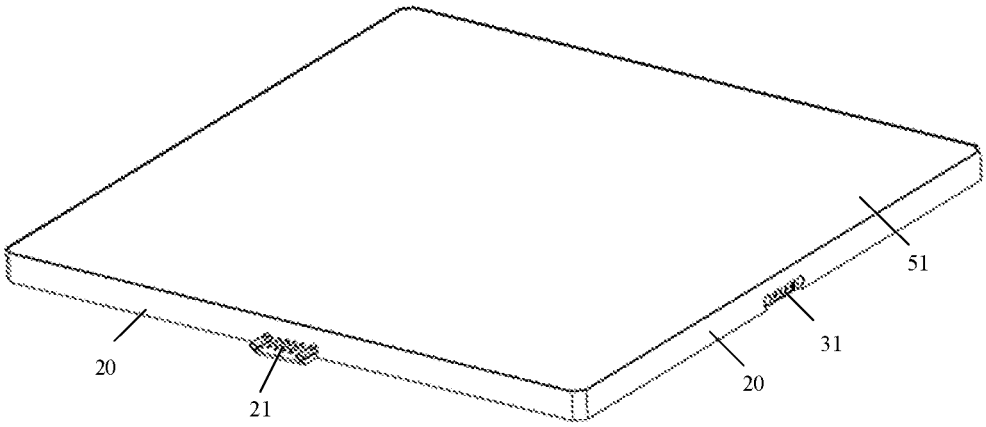
FIG. 2A shows a structural schematic diagram of a lamp according to one example of the present disclosure.

Examples of the present disclosure provide an assembled lamp. With reference to FIG. 1 and FIG. 2A, the assembled lamp 10 includes at least two lamps (FIG. 1 shows six lamps, i.e., a lamps 11 to a lamps 16) sequentially connected, wherein each lamp has a plurality of side walls 20, a first conductive terminal 21 is arranged on at least one of the plurality of side walls 20, a row hole 31 corresponding to the first conductive terminal 21 is disposed on other side wall 20, and a second conductive terminal (not shown) is arranged in the row hole 31.

Figure 2B:
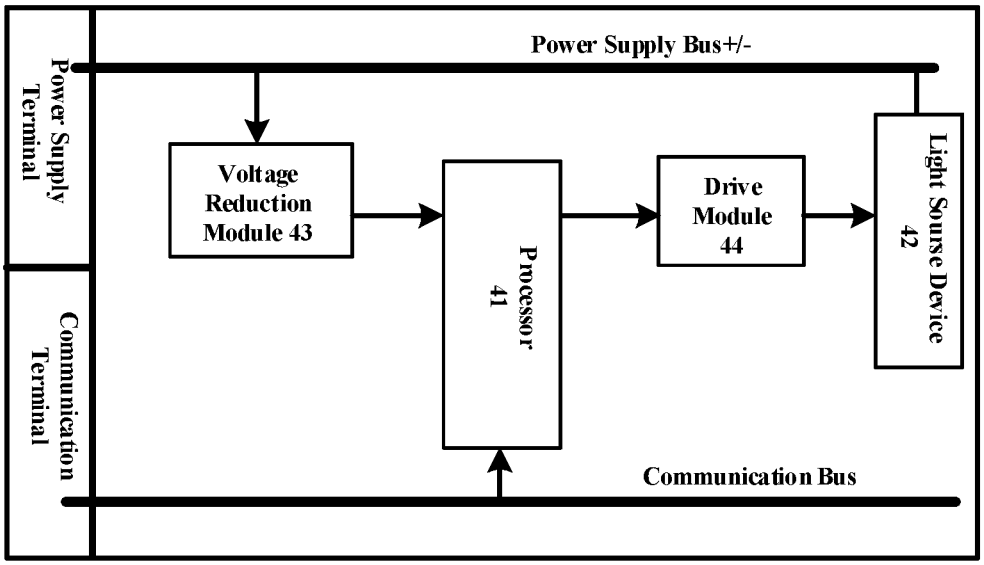
FIG. 2B shows a structural schematic diagram of the interior of a lamp according to one example of the present disclosure.

With reference to FIG. 1 to FIG. 2B, a power supply bus, a processor 41 and a light source device 42 which are connected with the power supply bus, and a communication bus connected with the processor 41 are also arranged inside the lamp, and both the power supply bus and the communication bus are connected with the first conductive terminal 21 and the second conductive terminal of the lamp, wherein there are two power supply buses, one power supply bus is used as a positive end, the other power supply bus is used as a negative end, in FIG. 2B, one line represents two positive and negative power supply buses, the power supply bus is connected with a power supply terminal in the first conductive terminal 21, and each terminal in the first conductive terminal 21 will be illustrated in detail hereafter, wherein the processor 41 may be a single chip microcomputer and also may be a circuit set up by a digital analog device, and the circuit has functions of receiving a signal, sending the signal and controlling a load.

In the assembled lamp 10, according to the examples of the present disclosure, two adjacent lamps respectively are a first lamp (e.g., the lamp 11 in FIG. 1) and a second lamp (e.g., the lamp 12 in FIG. 1), wherein the first conductive terminal 21 of the lamp 11 is inserted into the row hole 31 of the lamp 12 and connected with the second conductive terminal in the row hole 31, so that electrical connection and communication connection between two adjacent lamps can be implemented. In addition, in order to increase maintaining strength of connection between the first conductive terminal 21 and the second conductive terminal, magnet members (which are not shown in the drawings) also may be arranged on the first conductive terminal 21 and the second conductive terminal, or the first conductive terminal 21 and the second conductive terminal are set to be magnetic itself, so that after the first conductive terminal 21 of the first lamp is inserted into the row hole 31 of the second lamp with the second conductive terminal, the first conductive terminal 21 and the second conductive terminal absorb through the respective magnet members or absorb mutually because of being magnetic itself, thereby implementing mechanical connection between two adjacent lamps.

The power supply bus of the lamp 11 is used for receiving an external voltage signal, in one aspect, supplies power to the processor 41 and the light source device 42 inside, and in the other aspect, transmits the external voltage signal to the power supply bus of the lamp 12 via the conductive terminal in inserted connection therewith, so that the lamp 12 utilizes the received voltage signal to supply power to the processor 41 and the light source device 42 thereof, wherein the external voltage signal received by the power supply bus may be a voltage signal from an external power supply.

The communication bus of the lamp 11 receives a control signal from an external main controller (which is not shown in FIG. 1 to FIG. 2B), the lamp 11 transmits the control signal onto the communication bus of the lamp 12 through the conductive terminal in inserted connection with the lamp 11, and then the lamp 11 and the lamp 12 determines whether to transmit the control signal on the communication buses into the processors 41. In one example of the present disclosure, the external main controller may carry preset address information of any one of the lamps in the control signal, so that the lamp determines whether to adopt the control signal to control the light source device 42 of the lamp in a mode of matching the address information. For example, address information of the lamp 11 is carried in the control signal, so that after the control signal is transmitted onto the communication bus, each lamp matches the address information in the control signal with address information of the lamp itself, finally, only the lamp 11 succeeds in matching, the lamp 11 transmits the control signal into the processor 41 of the lamp 11, and the processor 41 controls a light-emitting state of the light source device 42 inside the lamp by utilizing the control signal.

Figure 3:
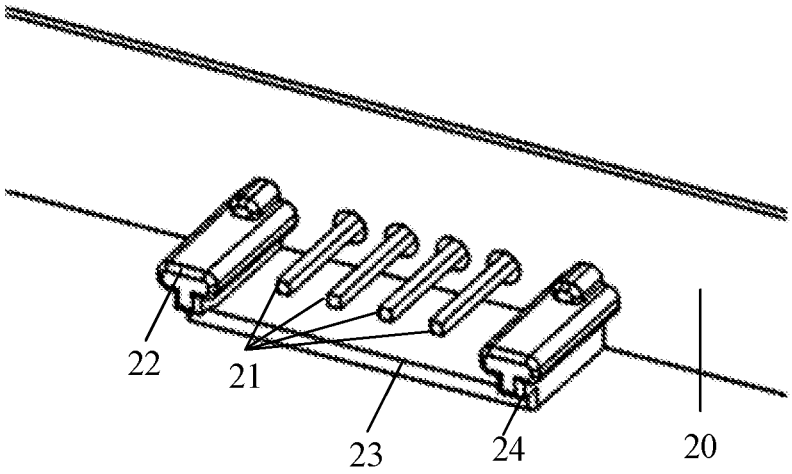
FIG. 3 shows a structural schematic diagram of a first conductive terminal of a lamp according to one example of the present disclosure.
Figure 4:
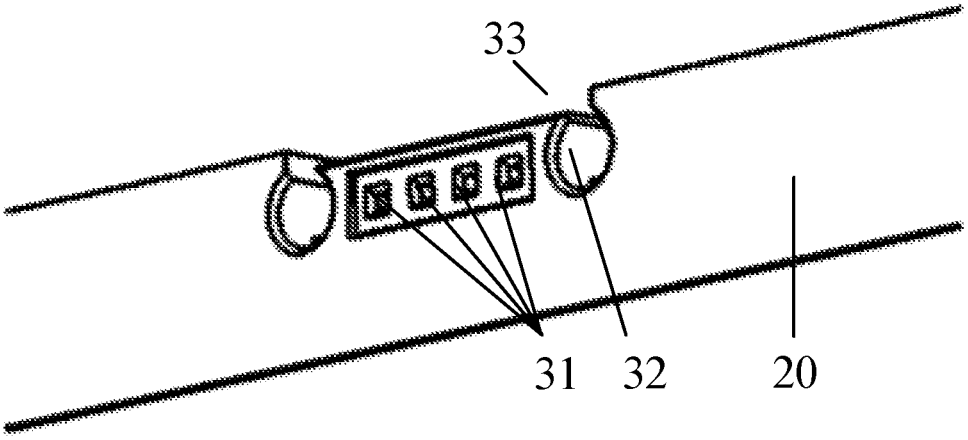
FIG. 4 shows a structural schematic diagram of a row hole of a lamp according to one example of the present disclosure.
Figure 5:
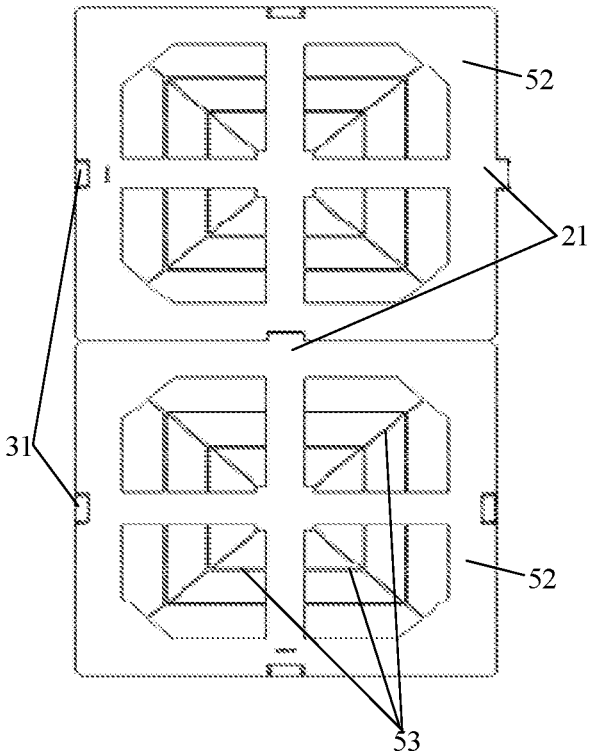
FIG. 5 shows a structural schematic diagram after two lamps are spliced according to one example of the present disclosure.

With reference to FIG. 3 and FIG. 4, the first conductive terminal 21 on the side wall 20 of the lamp is arranged along a vertical direction of the side wall 20, the first conductive terminal 21 of the lamp 11 is in inserted connection to the row hole 31 of the lamp 12, and after the first conductive terminal 21 is connected with the second conductive terminal (which is not shown in FIG. 3 and FIG. 4) in the row hole 31, the side walls 20 where the first conductive terminal 21 and the row hole 31 are respectively positioned are attached to each other. FIG. 5 shows a structural schematic diagram after two lamps are in inserted connection.

In one example of the present disclosure, with reference to FIG. 2A and FIG. 5, the lamp includes four side walls 20, the first conductive terminal 21 is arranged on one side wall 20, the row holes 31 and the second conductive terminals positioned in the row holes 31 are arranged on the other three side walls 20. Certainly, the first conductive terminal 21 and the second conductive terminal on the side walls 20 of the lamp also may adopt other combination modes, and for example, there are the first conductive terminals 21 on two side walls 20, there are the second conductive terminals on two side walls 20 and the like. In addition, the lamp also may have other numbers of side walls 20, such as three or five side walls and the like, and the examples of the present disclosure do not make any limit to it. In the example, a top surface 51 and a bottom surface 52 are respectively disposed at both ends of the side wall 20 of the lamp. The top surface 51 includes a light homogenization plate, light emitted by the light source device 42 (as shown in FIG. 2B) inside the lamp uniformly emerges through the light homogenization plate, and the light homogenization plate may be made of a Polycarbonate (PC) material and also may be made of other materials such as glass and the like. The bottom surface 52 is provided with a plurality of convex ribs 53 for reinforcing the bottom surface 52 of the lamp.

In the examples of the present disclosure, a capacitance sensor (not shown) also may be arranged on the light homogenization plate, and is connected with the light source device for emitting light inside the lamp, so that a user touches the surface of the light homogenization plate, the light homogenization plate is lighted up by sensing a capacitance of a human body. Specifically, when the user touches the light homogenization plate with a hand, the capacitance sensor on the light homogenization plate senses the capacitance of the hand of the user, so that the light source device may be controlled to emit light. Certainly, it also may be set as that when the user touches the light homogenization plate for the first time, the light source device emits light, and when the user touches the light homogenization plate again, the light source device is turned off, i.e., the light source device does not emit light.

With further reference to FIG. 3 and FIG. 4, a guide member 22 is also arranged on the side wall 20 where the first conductive terminal 21 of the lamp is positioned, and a guide groove 32 corresponding to the guide member 22 is also disposed on the side wall 20 where the row hole 31 is disposed. The guide member 22 shown in FIG. 3 is of a columnar structure, i.e., is a guide column, and correspondingly, the guide groove 32 shown in FIG. 4 is of a hole shape. In two adjacent lamps, the guide member 22 of the first lamp is in inserted connection into the guide groove 32 of the second lamp, and an opening diameter of the guide groove 32 is smaller than a groove internal diameter, wherein the guide member 22 and the guide groove 32 are used for ensuring that the first conductive terminal 21 and the second conductive terminal can be accurately positioned when being in inserted connection.

In the examples of the present disclosure, a stop wall 23 is also arranged on a side of the first conductive terminal 21 of the lamp, a side of the stop wall 23, which faces away the first conductive terminal 21, and a bottom surface of the lamp are positioned on the same plane, both ends of the stop wall 23 extend in a direction which is perpendicular to the stop wall 23 and towards the first conductive terminal 21 to form convex edges 24, and the guide member 22 of the lamp is arranged on a top of the convex edge 24. Correspondingly, a groove 33 corresponding to the stop wall 23 is disposed on a side of the row hole 31 of the lamp, a depth of the groove 33 is equal to a thickness of the stop wall 23, and the side wall of the groove 33 is recessed along a reverse direction of an opening of the groove to form the guide groove 32 of the lamp, wherein the design of the stop wall 23 may be used for protecting the exposed first conductive terminal 21 from being bent by an external force.

In two adjacent lamps, such as the adjacent lamp 11 and lamp 12 in FIG. 1, after the guide member 22 of the lamp 11 is in inserted connection to the guide groove 32 of the lamp 12, the stop wall 23 of the lamp 11 is in inserted connection into the groove 33 of the lamp 12, and due to a case that the depth of the groove 33 is equal to the thickness of the stop wall 23, the bottom surface of the lamp 11 and the bottom surface of the lamp 12 are positioned on the same plane.

With further reference to FIG. 2B to FIG. 4, in one example of the present disclosure, both the first conductive terminal 21 and the second conductive terminal include at least two terminals, wherein the at least two terminals include a positive end and a negative end and the positive end and the negative end are respectively and correspondingly connected with a positive end and a negative end of the power supply bus inside the lamp. Moreover, a terminal at the positive end is also connected with the communication bus inside the lamp and connected with the processor 41 of the lamp via the communication bus. After two adjacent lamps are in inserted connection through the first conductive terminal 21 and the row hole 31, the first conductive terminal 21 is connected with a terminal with a corresponding function in the second conductive terminal in the row hole 31, i.e., the positive end terminals and the negative end terminals of the two adjacent lamps, which are connected with the respective power supply buses, are respectively and correspondingly connected, and the terminals connected with the respective communication buses are correspondingly connected.

In the examples shown in FIG. 3 and FIG. 4, both the first conductive terminal 31 and the second conductive terminal include four terminals, and the four terminals include two power supply terminals, one communication terminal and one identification terminal, wherein two power supply terminals include a positive end and a negative end, and the positive end and the negative end are correspondingly connected with the positive end and the negative end of the power supply bus inside the lamp; one communication terminal is connected with the communication bus inside the lamp and connected with the processor 41 (as shown in FIG. 2B) of the lamp via the communication bus; and the other one is the identification terminal, the identification terminal is used for identifying the lamp connected therewith, the main controller configures the address information to the lamp connected with the identification terminal by the identification terminal for identifying the lamp. In one example of the present disclosure, an Input Output (IO) interface is also arranged inside each side wall of the lamp where the conductive terminal is arranged, and the identification terminal is connected with the IO interface on the side wall where the identification terminal is positioned, so that the IO interface may be identified by the identification terminal, and then the address information may be configured to the lamp connected with the IO interface subsequently, and how to configure the address information to the lamp connected with each IO interface will be specifically illustrated hereafter.

In one example of the present disclosure, signal communication between the external main controller and the assembled lamp also may be implemented in a mode of multiplexing a power line (i.e., the power supply bus), i.e., there is no need for the special communication bus to transmit the control signal, but transmission of the control signal is implemented in a mode of superposing the control signal on the power supply bus.

At the moment, the conductive terminal may include two power supply terminals, i.e., one positive end terminal and one negative end terminal, and the positive end terminal and the negative end terminal are respectively and correspondingly connected with the positive end and the negative end of the power supply bus inside the lamp. Certainly, the conductive terminal may include three power supply terminals, i.e., two power supply terminals and one identification terminal, moreover, the power supply bus inside the lamp is connected to the power supply terminals, and other portions in the lamp are not changed.

In the examples of the present disclosure, when the control signal is transmitted by adopting the communication bus, the control signal may be a digital signal, and when the control signal is transmitted through the power supply bus, the control signal may be an analog signal, i.e., an analog signal with pulses one by one. Certainly, the control signal also may be other forms of signals, and the examples of the present disclosure do not make any limit to it. Moreover, when the external main controller transmits the control signal to the assembled lamp, the control signal is transmitted by a customized transmission protocol, wherein a type of the transmission protocol may be a DMX512 (i.e., DMX Control 512) protocol, a Time To Live (TTL) protocol, a Modbus communication protocol, an IEC101 protocol, an IEC104 (i.e., Telecontrol equipment and systems-Part 5-104) protocol and the like.

With further reference to FIG. 2B, in one example of the present disclosure, the lamp internally further includes a voltage reduction module 43, one end of the voltage reduction module 43 is connected with the power supply bus, the other end of the voltage reduction module 43 is connected with the processor 41, and the voltage reduction module 43 receives the external voltage signal through the power supply bus and transmits the external voltage signal to the processor 41 after stabilizing the external voltage signal to a preset voltage value so as to provide a working voltage for the processor 41. For example, the preset voltage value is 3.3V, i.e., the voltage reduction module 43 provides the external voltage signal to the processor 41 after stabilizing the external voltage signal to 3.3V. Certainly, the preset voltage value also may be other values, and needs to be determined according to the working voltage of the processor 41. In the practical application, the voltage reduction module 43 may adopt a voltage converter, and the examples of the present disclosure do not make any limit to it.

In this example, the lamp internally further includes a drive module 44, the drive module 44 is respectively connected with the processor 41 and the light source device 42 (for example, a Light-Emitting Diode (LED)) inside the lamp, after receiving the control signal by utilizing the communication bus and processing the control signal, the processor 41 transmits the processed control signal to the drive module 44, and the drive module 44 generates a corresponding drive signal according to the processed control signal and drives the light source device 42 to emit light or be turned off by utilizing the drive signal.

In the example, the control signal may include a signal for controlling the random lamp to emit light or be turned off, and also may include a signal for carrying out dimming control and/or color modulation control on the random lamp.

Specifically, the control signal may control one, multiple or all lamps of the assembled lamp to emit light or be turned off (i.e., not to emit light). Certainly, according to the examples of the present disclosure, brightness and a color temperature of the lamp also may be controlled by the external main controller through sending the control signal, and for example, the processor 41 inside the lamp may generate a corresponding Pulse Width Modulation (PWM) signal according to the control signal after receiving the control signal and processing the control signal so as to transmit the PWM signal to the drive module 44, and the drive module 44 generates the corresponding drive signal according to the PWM signal so as to regulate a color and/or the brightness of the light source device 42. The light source device 42 may adopt a Red Green Blue (RGB) chip, and the PWM signal implements regulation on the color of the light source device 42, i.e., implements regulation on the color of the lamp, by regulating respective occupied percentages of red (R), green (G) and blue (B) in the RGB chip. Certainly, the light source device 42 also may adopt a plurality of LEDs with different colors, and regulation on the color of the lamp is implemented by regulating on-off of each color of LED. Regulation on the brightness of the lamp is also implemented by the PWM signal with a corresponding duty ratio, which is generated according to the control signal.

Figure 6A:
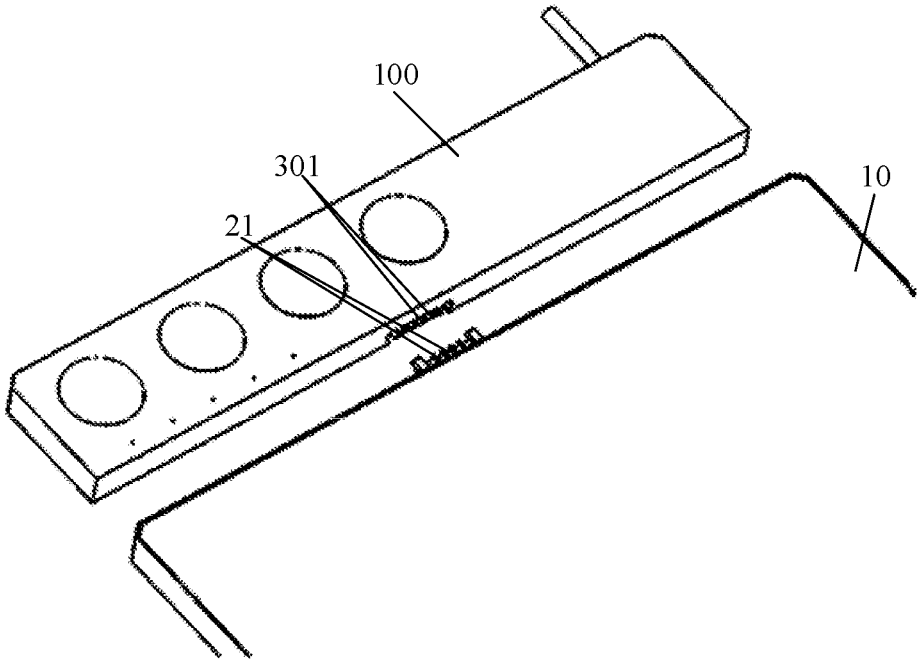
FIG. 6A shows a structural schematic diagram of a lighting system according to one example of the present disclosure.

Based on the same inventive concept, examples of the present disclosure further provide a lighting system. In connection with FIG. 3 and FIG. 4 and with reference to FIG. 6A to FIG. 6C, the lighting system includes a main controller 100 and the assembled lamp 10 (as shown in FIG. 1) in any one of the examples above, and the assembled lamp 10 is connected with the main controller 100.

Figure 6B:
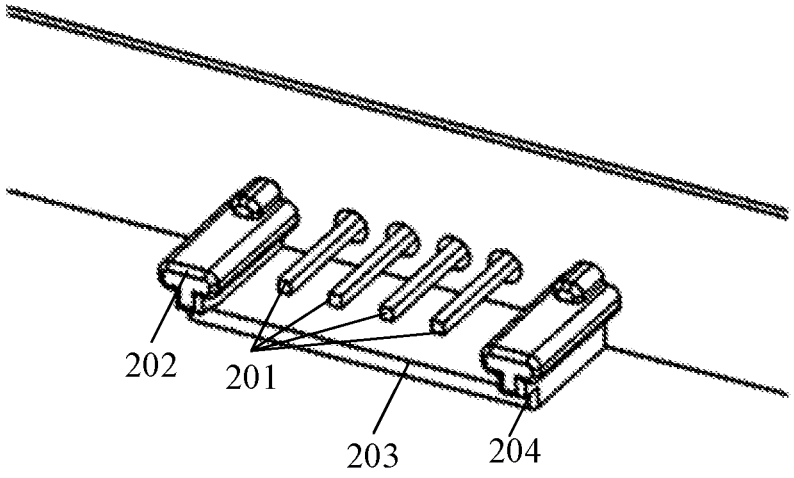
FIG. 6B shows a structural schematic diagram of a first conductive terminal of a main controller according to one example of the present disclosure.
Figure 6C:
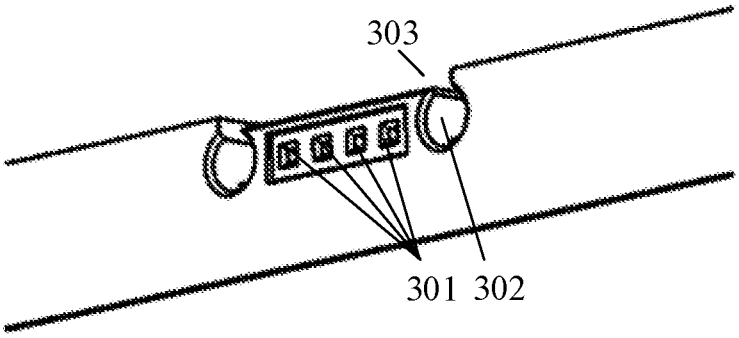
FIG. 6C shows a structural schematic diagram of a row hole of a main controller according to one example of the present disclosure.

A first conductive terminal 201 (as shown in FIG. 6B) or a row hole 301 in which a second conductive terminal (not shown) is arranged is arranged at any one end of the main controller 100, the main controller 100 internally includes a control module (not shown) for generating a control signal and a communication bus (not shown) and a power supply bus (not shown) which are respectively connected with the control module, and both the power supply bus and the communication bus are connected with the first conductive terminal 201 or the second conductive terminal thereon.

The first conductive terminal 201 of the main controller 100 is inserted into the row hole 31 of any one lamp and connected with the second conductive terminal in the row hole 301. Or, the first conductive terminal 21 of any one lamp is inserted into the row hole 301 of the main controller 100 and connected with the second conductive terminal in the row hole 301, so as to implement electrical connection and communication connection between the main controller 100 and the assembled lamp 10. The main controller 100 in the example as shown in FIG. 6A is provided with the row hole 301 in which the second conductive terminal is arranged.

In addition, no matter the first conductive terminal or the second conductive terminal of the main controller, or the first conductive terminal and the second conductive terminal of the lamp, in order to increase maintaining strength of connection between the first conductive terminal and the second conductive terminal, a magnet member (not shown) also may be arranged on each of the conductive terminals, or the first conductive terminal and the second conductive terminal are set to being magnetic, so that when the conductive terminals of the main controller and the lamp are connected, i.e., after the first conductive terminal of the main controller is inserted into the row hole of the lamp, or the first conductive terminal of the lamp is inserted into the row hole of the main controller, the random connected conductive terminals absorb mutually by using the own magnet members or absorb mutually because of being magnetic itself, so as to implement mechanical connection between the main controller and the lamp. It can be known from the examples above, mechanical connection also may be implemented between the lamps in the assembled lamp through the conductive terminals, so that mechanical connection between the main controller and the assembled lamp is implemented.

The power supply bus of the main controller 100 receives an external voltage signal (the external voltage signal may be a voltage signal from an external power supply), supplies power to the control module inside, transmits the external voltage signal to a power supply bus of each lamp in the assembled lamp 10 via the conductive terminals in inserted connection therewith, and supplies power to the processor 41 (with reference to FIG. 2B) and the light source device 42 (with reference to FIG. 2B) inside each lamp.

The control module of the main controller 100 generates a control signal and transmits the control signal onto a communication bus of each lamp in the assembled lamp 10 by utilizing the conductive terminal in inserted connection therewith, so that the processor of at least one lamp can control a light-emitting state of the light source device inside by utilizing the control signal on the communication bus.

Figure 7A:
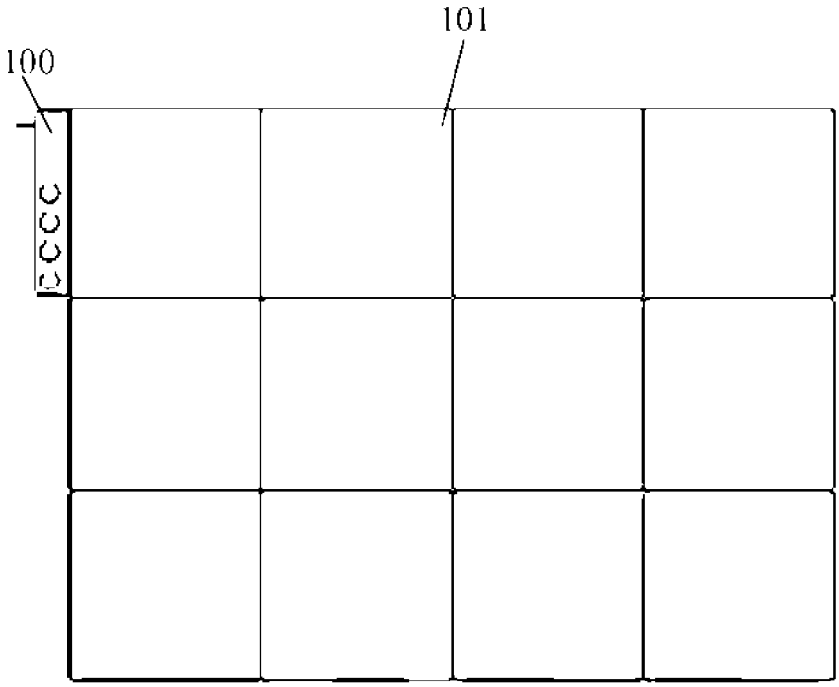
FIG. 7A shows a structural schematic diagram of a lighting system according to one example of the present disclosure.
Figure 7B:
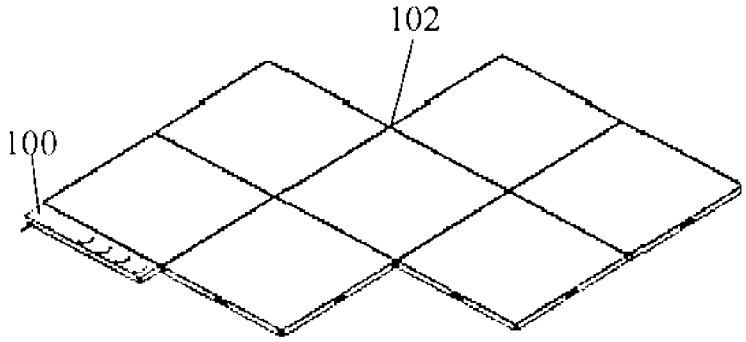
FIG. 7B shows a structural schematic diagram of a lighting system according to another example of the present disclosure.
Figure 7C:
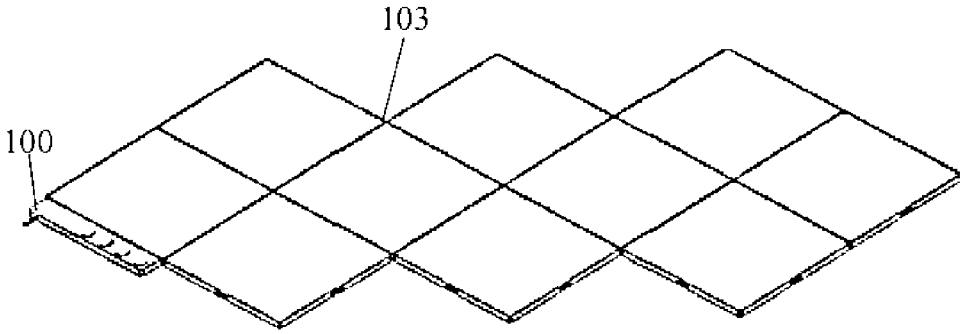
FIG. 7C shows a structural schematic diagram of a lighting system according to yet another example of the present disclosure.

In addition, the number of the lamps in the lighting system may be a random number, and the lamps may be spliced into the assembled lamp with a random shape, e.g., an assembled lamp 101 as shown in FIG. 7A, an assembled lamp 102 as shown in FIG. 7B and an assembled lamp 103 as shown in FIG. 7C.

In one example of the present disclosure, if the main controller 100 is provided with the first conductive terminal 201, the main controller 100 is provided with a guide member 202 positioned on the same lateral surface with the first conductive terminal 201 and corresponding to a guide groove 302 of the lamp, and the guide member 202 is in inserted connection with the guide groove 302 of any one lamp.

A stop wall 203 corresponding to a groove 303 of the lamp is also arranged on a side of the first conductive terminal 201 of the main controller 100, a side of the stop wall 203 which faces away the first conductive terminal 201 and a bottom surface of the main controller 100 are positioned on the same plane, a thickness of the stop wall 203 is equal to a depth of the groove 303 of the lamp, both ends of the stop wall 203 extend in a direction which is perpendicular to the stop wall 203 and towards the first conductive terminal 201 to form convex edges 204, and the guide member 202 of the main controller 100 is arranged at a top of the convex edge 204. Moreover, the stop wall 203 of the main controller 100 is in inserted connection into the groove 303 of any one lamp, and the bottom surface of the main controller 100 and a bottom surface of the lamp are positioned on the same plane.

In another example of the present disclosure, if the main controller 100 is provided with the row hole 301 in which the second conductive terminal is arranged, the main controller 100 is provided with a guide groove 302 positioned on the same lateral surface with the row hole 301 and corresponding to a guide member 202 of the lamp, and the guide groove 302 is in inserted connection with the guide member 202 of any one lamp.

A groove 303 corresponding to a stop wall 203 of the lamp is disposed on a side of the row hole 301 of the main controller 100, a depth of the groove 303 is equal to a thickness of the stop wall 203 of the lamp, and a side wall of the groove 303 is recessed along a reverse direction of an opening of the groove to form the guide groove 302 of the lamp. The stop wall 203 of any one lamp is in inserted connection into the groove 303 of the main controller 100, and the bottom surface of the lamp and the bottom surface of the main controller 100 are positioned on the same plane.

In one example of the present disclosure, the first conductive terminal 201 or the second conductive terminal of the main controller 100 includes at least two terminals, and correspondingly, both the first conductive terminal 21 and the second conductive terminal of the lamp include at least two terminals, wherein at least two terminals in the conductive terminals of the lamp include two power supply terminals, the two power supply terminals are respectively used as a positive end terminal and a negative end terminal, the positive end terminal and the negative end terminal are correspondingly connected with a positive end and a negative end of the power supply bus inside the lamp, and the positive end terminal is connected with the communication bus inside the lamp and connected with the processor of the lamp via the communication bus. At least two terminals in the conductive terminals of the main controller 100 include two power supply terminals, i.e., a positive end and a negative end, and the positive end and the negative end are correspondingly connected with a positive end and a negative end of the power supply bus inside the main controller 100. A terminal at the positive end is connected with the control module of the main controller 100. After the main controller 100 is connected with the assembled lamp through the conductive terminals, the terminals with the corresponding functions are connected.

For example, the main controller 100 is provided with four conductive terminals, wherein two terminals are power supply terminals and are respectively used as a positive end terminal and a negative end terminal, and the positive end terminal and the negative end terminal are correspondingly connected with the positive end and the negative end of the power supply bus inside the main controller 100. One communication terminal and one identification terminal are respectively connected with the control module of the main controller 100. The identification terminal of the main controller 100 identifies the lamp connected with each identification terminal in the assembled lamp. Correspondingly, both the first conductive terminal 21 and the second conductive terminal of the lamp include four terminals, wherein in the conductive terminals of the lamp, two terminals are respectively used as a positive end and a negative end, and the positive end and the negative end are correspondingly connected with a positive end and a negative end of the power supply bus inside the lamp. One communication terminal is connected with the communication bus inside the lamp and connected with the processor of the lamp via the communication bus. One identification terminal is used for identifying the lamp connected therewith, and the main controller identifies other lamps connected with the lamp by the identification terminal identifying the lamp, so as to subsequently configure address information to the connected lamp.

In the examples of the present disclosure, if the assembled lamp includes at least two lamps sequentially connected, the main controller may be physically connected with any one lamp in the assembled lamp through the conductive terminals, so as to implement connection between the main controller and the assembled lamp. As illustrated in the examples above, both the main controller and the lamp are provided with two power supply terminals, one communication terminal and one identification terminal, the identification terminal of the main controller is connected with the control module thereof, the identification terminal of the lamp is connected with an IO interface on the side wall of the lamp, and actually, it can be understood that the power supply buses inside the lamps are connected and the communication buses in the lamps are connected. Moreover, the power supply bus inside the main controller is connected with the power supply bus of the lamp, the control module of the main controller is connected with the communication bus of the lamp, and the main controller is connected with the IO interface of each lamp. Further, it can be understood that the connected communication buses connect the control module of the main controller with the processor of each lamp, so that communication between the main controller and the random lamp can be implemented, and moreover, the connected power supply buses can provide the required working voltages to the main controller and each lamp.

Figure 8:
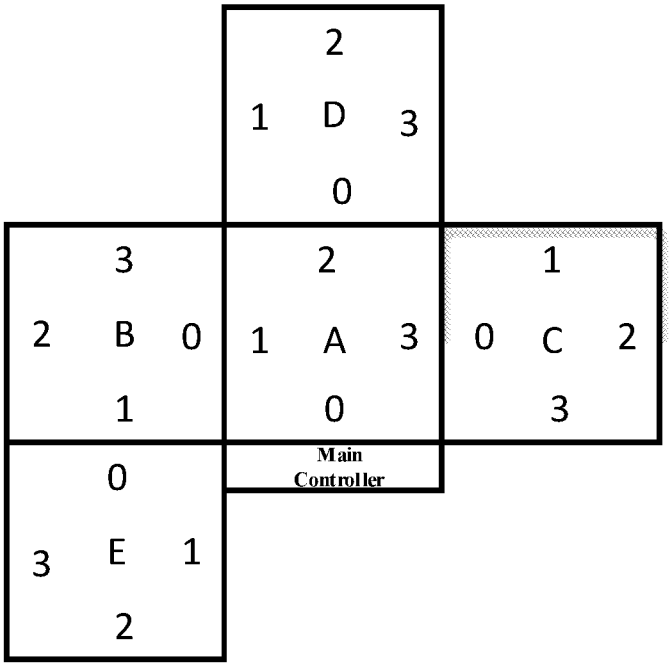
FIG. 8 shows a structural schematic diagram of a lighting system according to one example of the present disclosure.

By taking the lighting system as shown in FIG. 8 as an example, the process that the main controller in the lighting system identifies the IO interface of each lamp by the identification terminal and configures the address information to the lamp connected with the IO interface will be illustrated below. Where, A, B, C, D and E respectively represent the lamps, and numbers 0, 1, 2 and 3 respectively represent numbers of the IO interfaces of the lamps.

Step 1: the main controller identifies a lamp A (i.e., a lamp A) physically connected with the main controller by the identification terminal, sets the lamp A as a central node, and configures coordinate values of the lamp A as (128, 128), i.e., both an x-axis coordinate value and a y-axis coordinate value are 128. Meanwhile, the number of the IO interface of the lamp A, which is connected with the main controller, is set as 0, and the numbers of other IO interfaces respectively are 1, 2 and 3 in a clockwise direction. Moreover, the IO interfaces of other lamps are also numbered according to such rule. Certainly, the IO interfaces also may be numbered according to other rules, but the numbering rule of the IO interfaces of each lamp should be the same. The sequence of the numbers of the IO interfaces also may be used as a sequence of configuring the address information to the lamps.

Step 2: the control module of the main controller detects a connection case of each IO interface on the lamp A by using the identification terminal and determines that the interfaces 1, 2 and 3 are all connected to a next stage of lamps.

Step 3: the main controller respectively configures different coordinate values (i.e., unique address information) to the next stage of lamps B, C and D (i.e., lamps B, C and D) connected with the lamp A according to a preset algorithm strategy on the basis of the coordinate values of the lamp A and coordinate axis directions of the IO interfaces on three interfaces. Therefore, coordinate values of the lamp B are (127, 128), coordinate values of the lamp C are (129, 128), and coordinate values of the lamp D are (128, 129). Moreover, the main controller respectively sets numbers as shown in FIG. 5 for each IO interface of the lamps B, C and D.

Step 4: the control module of the main controller moves a current detection node to a next node, i.e., the lamp B, detects a connection case of each IO interface on the lamp B by the identification terminal on the lamp B, and in the example, determines that the No. 1 IO interface of the lamp B is connected with a lamp E. Further, similarly, on the basis of the coordinate values of the lamp B and coordinate axis directions of the IO interfaces on three interfaces, coordinate values (127, 127) are set for the lamp E in the mode in the above step 3.

Step 5: the main controller moves a current detection node to a next node, i.e., the lamp E, detects a connection case of each IO interface on the lamp E, and does not detect out connection of the next stage of lamp.

Step 6: the main controller moves a current detection node to a next node, i.e., the lamp C, detects a connection case of each IO interface on the lamp C, and does not detect out connection of the next stage of lamp.

Step 7, the main controller moves a current detection node to a next node, i.e., the lamp D, detects a connection case of each IO interface on the lamp D, and does not detect out connection of the next stage of lamp. So far, the main controller completes configuration of the coordinate values to each lamp of the assembled lamp, i.e., completes configuration of the address information to each lamp.

The preset algorithm strategy in the step 3 above may be a strategy as follows.

Specifically, firstly, establishing a coordinate system for the assembled lamp, and according to the established coordinate system, configuring coordinate values of a central node. For example, a rectangular coordinate system is established for the assembled lamp, and in the rectangular coordinate system, the coordinate values configured to the central node are (128, 128).

Then, marking each lamp in the assembled lamp as one node, using the central node as a previous stage of node, acquiring the IO interface of the previous stage of node which is connected with a next stage of node, and determining a coordinate axis direction of the IO interface, wherein each lamp is marked as one node, i.e., each lamp occupies for one coordinate position in the rectangular coordinate system. In this example, the coordinate axis direction means a direction of the IO interface of each lamp on each coordinate axis (for example, an x axis and a y axis) in the coordinate system with respect to the central node.

Then, according to the coordinate axis direction of the IO interface of the previous stage of node, which is connected with the next stage of node, determining a node type and a node direction of the next stage of node, and in connection with the coordinate values of the previous stage of node and the node type and the node direction of the next stage of node connected with the previous stage of node, determining coordinate values of the next stage of node, wherein the node type of the examples of the present disclosure may include three types, i.e., the central node, a common node and a turning node. Moreover, the defining principle of each node type is as follows: the lamp physically connected with the main controller is used as the central node, a node of which a longitudinal coordinate is changed with respect to the central node in the rectangular coordinate system is the turning node, and the rest of nodes are the common nodes. For the node direction, the example defines that by using the central node as a base point, a node spliced leftwards is a x-axis negative direction node, a node spliced rightwards is a x-axis positive direction node, a node spliced downwards is a y-axis negative direction node, and a node spliced upwards is a y-axis positive direction node.

Finally, continuing to use the node of which the coordinate values are determined latest as a previous stage of node, determining a node type and a node direction of a next stage of node connected with the previous stage of node according to the coordinate axis direction of the IO interface of the previous stage of node, which is connected with the next stage of node, and determining coordinate values of the next stage of node in connection with the latest determined coordinate values, until the coordinate values of the nodes corresponding to all the lamps in the assembled lamp are determined.

In one example of the present disclosure, after the main controller completes configuration of the address information to each lamp, a mechanism of host-slave communication protocol may be adopted to control the light-emitting state of the lamp by the main controller, wherein the main controller is used as a host, and the assembled lamp is used as a slave. In each communication process, the host initiates a communication request, and the slave responds to the request of the host. The communication process of the main controller and the lamp will be illustrated below.

Specifically, when the control module of the main controller receives a control instruction which is used for controlling the light-emitting state of the assembled lamp and carries at least one piece of address information, at least one piece of address information carried in the control instruction is parsed, the corresponding control signal is generated according to the control instruction, the address information obtained by parsing is carried in the control signal to be sent onto the communication bus, due to connection between each lamp of the assembled lamp and the communication bus, each lamp may match the address information in the control signal on the communication bus with the address information of the lamp itself, if matching is successful, the lamp receives the corresponding control signal by utilizing the communication bus and transmits the control signal into the processor to control the light-emitting state by the processor, so as to implement control on the light-emitting state of the assembled lamp.

In one example of the present disclosure, if the main controller is provided with a control panel, information for controlling the light-emitting state of the assembled lamp and the address information of the controlled lamp, which are set by the user through the control panel, may be directly received. If the main controller is not provided with the control panel, but has a communication function of establishing communication connection with an external device (not shown), the control instruction from the external device, which is used for controlling the light-emitting state of the assembled lamp and carries the address information, may be received. The examples of the present disclosure do not make any specific limit to a mode that the main controller receives the control instruction, wherein the external device may be a hand-held device, such as a smartphone in which an Application (APP) capable of communicating with the assembled lamp is installed, and also may be a terminal device and the like.

In this example, if the external device adopts the smartphone, and the APP capable of communicating with the assembled lamp is installed in the smartphone, after the main controller completes configuration of the address information (for example, the coordinate values) to each lamp, a schematic image of the assembled lamp also may be formed on an interface of the APP according to a position of each lamp, and the coordinate values of each lamp are labeled on the image, so as to facilitate visually selecting the lamp which needs to be controlled by the user through a display interface of the smartphone.

In one example of the present disclosure, if a new lamp is added in the assembled lamp, or the lamp is removed from the assembled lamp, the address information of each lamp in the regulated assembled lamp (i.e., the current assembled lamp) is updated according to an address configuration mode of the examples above, and correspondingly, the schematic image of the assembled lamp in the APP interface is updated.

Optionally, the first conductive terminal on the side wall of the lamp is arranged along a vertical direction of the side wall, after the first conductive terminal of the first lamp is in inserted connection to the row hole of the second lamp and the first conductive terminal is connected with the second conductive terminal in the row hole, the side walls where the first conductive terminal and the row hole are respectively positioned are attached to each other.

Optionally, a guide member is also arranged on a side wall where the first conductive terminal of the lamp is positioned, and a guide groove corresponding to the guide member is also disposed on a side wall where the row hole is disposed; and in the two adjacent lamps, the guide member of the first lamp is in inserted connection into the guide groove of the second lamp, and an opening diameter of the guide groove is smaller than a groove internal diameter of the guide groove.

Optionally, a stop wall is arranged on a side of the first conductive terminal of the lamp, a side of the stop wall which faces away the first conductive terminal and a bottom surface of the lamp are positioned on a same plane, both ends of the stop wall extend in a direction which is perpendicular to the stop wall and towards the first conductive terminal to form convex edges, and the guide member of the lamp is arranged on a top of the convex edge; a groove corresponding to the stop wall is disposed on a side of the row hole of the lamp, a depth of the groove is equal to a thickness of the stop wall, and a side wall of the groove is recessed along a reverse direction of an opening of the groove to form the guide groove of the lamp; in the two adjacent lamps, after the guide member of the first lamp is in inserted connection to the guide groove of the second lamp, the stop wall of the first lamp is in inserted connection into the groove of the second lamp, and a bottom surface of the first lamp and a bottom surface of the second lamp are positioned on a same plane; and the guide member is a guide column.

Optionally, the lamp has four side walls, wherein the first conductive terminal is arranged on one of the four side walls, the row holes are disposed on other three side walls of the four side walls, and the second guide terminal is arranged in the row hole.

Optionally, a top surface and a bottom surface are respectively disposed at both ends of the side wall of the lamp; and the top surface includes a light homogenization plate, and light emitted by the light source device inside the lamp uniformly emerges through the light homogenization plate.

Optionally, a capacitance sensor is arranged on the light homogenization plate, the capacitance sensor is connected with the light source device inside the lamp, and when sensing a capacitance generated by a user, the capacitance sensor controls the light source device to emit light.

Optionally, each of the first conductive terminal and the second conductive terminal includes at least two terminals, the at least two terminals include a positive end and a negative end, the positive end and the negative end are respectively and correspondingly connected with a positive end and a negative end of the power supply bus inside the lamp, and a terminal at the positive end is connected with the communication bus inside the lamp and connected with the processor of the lamp via the communication bus; and after the two adjacent lamps are in inserted connection through the first conductive terminal and the row hole, the first conductive terminal is connected with a terminal with a corresponding function in the second conductive terminal in the row hole.

Optionally, each of the first conductive terminal and the second conductive terminal includes four terminals, the four terminals includes: two power supply terminals including a positive end terminal and a negative end terminal, and the positive end terminal and the negative end terminal are respectively and correspondingly connected with the positive end and the negative end of the power supply bus inside the lamp; one communication terminal, connected with the communication bus inside the lamp and connected with the processor of the lamp via the communication bus; and one identification terminal, configured to identify the lamp connected with the one identification terminal, and the external main controller configures address information to the lamp connected with the identification terminal by the identification terminal identifying the lamp.

Optionally, the lamp internally further includes: a voltage reduction module, one end of the voltage reduction module being connected with the power supply bus and the other end of the voltage reduction module being connected with the processor, the voltage reduction module receiving the external voltage signal through the power supply bus, stabilizing the external voltage signal to a preset voltage value and transmitting the external voltage signal to the processor so as to provide a working voltage for the processor; and a drive module, respectively connected with the processor and the light source device in the lamp, after receiving the control signal by utilizing the communication bus and processing the control signal, the processor transmitting the processed control signal to the drive module, and the drive module generating a corresponding drive signal according to the processed control signal so as to control a light-emitting state of the light source device.

Optionally, the processor includes a single chip microcomputer; and the control signal includes: a signal for controlling anyone of the lamps to emit light or be turned off; and/or a signal for carrying out dimming control and/or color modulation control on anyone of the lamps, wherein a type of the control signal includes a digital signal type.

Optionally, magnet members are arranged on both the first conductive terminal and the second conductive terminal, or the first conductive terminal and the second conductive terminal have magnetism; and after the first conductive terminal of the first lamp is inserted into the row hole of the second lamp with the second conductive terminal, the first conductive terminal and the second conductive terminal absorb through the respective magnet members or absorb mutually through the respective magnetism so as to implement mechanical connection between the two adjacent lamps.

Optionally, the main controller is provided with a guide member positioned on a same lateral surface with the first conductive terminal and corresponding to a guide groove of the lamp, the guide member is in inserted connection with the guide groove of any one of the lamps; or the main controller is provided with a guide groove positioned on a same lateral surface with the row hole and corresponding to a guide member of the lamp, the guide groove is in inserted connection with the guide member of any one of the lamps.

Optionally, a stop wall corresponding to a groove of the lamp is arranged on a side of the first conductive terminal of the main controller, a side of the stop wall facing away the first conductive terminal and a bottom surface of the main controller are positioned on a same plane, a thickness of the stop wall is equal to a depth of the groove of the lamp, both ends of the stop wall extend in a direction which is perpendicular to the stop wall and towards the first conductive terminal to form convex edges, and the guide member of the main controller is arranged at a top of the convex edge; the stop wall of the main controller is in inserted connection into the groove of any one of the lamps, and a bottom surface of the main controller and a bottom surface of the lamp are positioned on a same plane; or a groove corresponding to a stop wall of the lamp is disposed on a side of the row hole of the main controller, a depth of the groove is equal to a thickness of the stop wall of the lamp, and a side wall of the groove is recessed along a reverse direction of an opening of the groove to form the guide groove of the lamp; and the stop wall of any one of the lamps is in inserted connection into the groove of the main controller, and the bottom surface of the lamp and the bottom surface of the main controller are positioned on a same plane.

Optionally, the first conductive terminal or the second conductive terminal of the main controller includes at least two terminals, and correspondingly, each of the first conductive terminal and the second conductive terminal of the lamp includes at least two terminals, the at least two terminals in the conductive terminal of the lamp include a positive end and a negative end, the positive end and the negative end are respectively and correspondingly connected with a positive end and a negative end of the power supply bus inside the lamp, and a terminal at the positive end is connected with the communication bus inside the lamp and connected with the processor of the lamp via the communication bus; and the at least two terminals in the conductive terminal of the main controller include a positive end and a negative end, the positive end and the negative end are respectively and correspondingly connected with a positive end and a negative end of the power supply bus inside the main controller, and a terminal at the positive end is connected with the control module of the main controller; and after the main controller is connected with the assembled lamp through the conductive terminals, the terminals with the corresponding functions are connected with each other.

Optionally, each of the first conductive terminal and the second conductive terminal of the lamp includes four terminals, the four terminals includes two power supply terminals, one communication terminal and one identification terminal, in the conductive terminal of the lamp, the two power supply terminals include a positive end terminal and a negative end terminal, and the positive end terminal and the negative end terminal are correspondingly connected with the positive end and the negative end of the power supply bus inside the lamp; the one communication terminal is connected with the communication bus inside the lamp and connected with the processor of the lamp via the communication bus; the one identification terminal is used for identifying the lamp connected with the identification terminal, and the main controller configures address information to the lamp connected with the identification terminal by the identification terminal for identifying the lamp; the conductive terminal of the main controller includes four terminals, wherein two power supply terminals include a positive end terminal and a negative end terminal, and the positive end terminal and the negative end terminal are correspondingly connected with the positive end and the negative end of the power supply bus inside the main controller; one communication terminal and one identification terminal are respectively connected with the control module of the main controller; and after the main controller is connected with the assembled lamp through the conductive terminals, the terminals with the corresponding functions are connected with each other.

Optionally, a magnet member is arranged on the first conductive terminal or the second conductive terminal of the main controller, and corresponding magnet members are also arranged on the first conductive terminal and the second conductive terminal of the lamp; after the first conductive terminal of the main controller is inserted into the row hole of the lamp, or the first conductive terminal of the lamp is inserted into the row hole of the main controller, the first conductive terminal and the second conductive terminal connected with each other absorb mutually by the respective magnet members so as to implement mechanical connection between the main controller and the lamp; or the first conductive terminal or the second conductive terminal of the main controller has magnetism, and the first conductive terminal and the second conductive terminal of the lamp have magnetism; and after the first conductive terminal of the main controller is inserted into the row hole of the lamp, or the first conductive terminal of the lamp is inserted into the row hole of the main controller, the first conductive terminal and the second conductive terminal connected with each other absorb mutually through the respective magnetism so as to implement mechanical connection between the main controller and the lamp.

Optionally, the control module of the main controller generates a control signal, and transmits the control signal onto the communication bus of each of the lamps in the assembled lamp on the basis of a customized transmission protocol by utilizing the conductive terminal in inserted connection with the main controller.

In the examples of the present disclosure, by arranging the first conductive terminal on at least one side wall of each lamp in the assembled lamp and the row hole with the second conductive terminal on the other side walls, so that any two lamps can be in inserted connection with each other by the first conductive terminal and the second conductive terminal in the row hole on them. Because the lamp is also provided with a power supply bus, a light source device and a processor connected to the power supply bus, and a communication bus connected to the processor inside, and each of the power supply bus and the communication bus is connected to the first conductive terminal and the second conductive terminal of the lamp. Therefore, the mechanical connection, electrical connection, and communication connection between adjacent two lamps are simultaneously achieved by the inserted connection of the first conductive terminal and the second conductive terminal in the row hole. Therefore, the solution of the example of the present disclosure can simplify the operation of the mechanical connection, electrical connection, and communication connection between the lamps, and save the complicated steps for arranging a plurality of wires between the lamps. In addition, the plug-in way of the lamp also makes the combined assembled lamp more beautiful.

The above description is only an overview of the technical solutions of the present disclosure. In order to understand the technical means of the present disclosure more clearly, it can be implemented in accordance with the content of the specification, and in order to make the above and other objects, features and advantages of the present disclosure more obvious, the specific examples of the present disclosure are listed below.

Until now, those skilled in the art should realize that although a plurality of exemplary examples of the present invention have been shown and described in detail herein, many other variations or modifications which are consistent with the principles of the present invention may be directly determined or derived still according to the content disclosed in the examples of the present invention, without departing from the spirit and scope of the present invention. Therefore, the scope of the examples of the present invention should be understood and deemed to cover all these other variations or modifications.

The invention claimed is:

1. An assembled lamp, comprising:

a first lamp and a second lamp sequentially connected, wherein each of the first lamp and the second lamp includes a plurality of side walls, a first conductive terminal is arranged on at least one of the plurality of side walls, a row hole corresponding to the first conductive terminal is disposed on other side wall of the plurality of side walls, and a second conductive terminal is arranged in the row hole;

wherein each of the first lamp and the second a power supply bus, a light source device and a processor which are connected with the power supply bus, and a communication bus connected with the processor are arranged inside the lamp, and each of the power supply bus and the communication bus is connected with the first conductive terminal and the second conductive terminal of the lamp;

wherein the first conductive terminal of the first lamp is inserted into the row hole of the second lamp and connected with the second conductive terminal in the row hole so as to implement electrical connection and communication connection between the two adjacent lamps;

wherein the power supply bus of the first lamp receives an external voltage signal, supplies power to the processor and the light source device inside, and transmits the external voltage signal to the power supply bus of the second lamp via the conductive terminal in inserted connection with the first lamp; and the communication bus of the first lamp receives a control signal from an external main controller, and transmits the control signal onto the communication bus of the second lamp via the conductive terminal in inserted connection with the first lamp.

2. The assembled lamp according to claim 1, wherein the first conductive terminal on the side wall of the lamp is arranged along a vertical direction of the side wall, after the first conductive terminal of the first lamp is in inserted connection to the row hole of the second lamp and the first conductive terminal is connected with the second conductive terminal in the row hole, the side walls where the first conductive terminal and the row hole are respectively positioned are attached to each other.

3. The assembled lamp according to claim 1, wherein a guide member is also arranged on a side wall where the first conductive terminal of the lamp is positioned, and a guide groove corresponding to the guide member is also disposed on a side wall where the row hole is disposed; and in the two adjacent lamps, the guide member of the first lamp is in inserted connection into the guide groove of the second lamp, and an opening diameter of the guide groove is smaller than a groove internal diameter of the guide groove.

4. The assembled lamp according to claim 3, wherein a stop wall is arranged on a side of the first conductive terminal of the lamp, a side of the stop wall which faces away the first conductive terminal and a bottom surface of the lamp are positioned on a same plane, both ends of the stop wall extend in a direction which is perpendicular to the stop wall and towards the first conductive terminal to form convex edges, and the guide member of the lamp is arranged on a top of the convex edge;

a groove corresponding to the stop wall is disposed on a side of the row hole of the lamp, a depth of the groove is equal to a thickness of the stop wall, and a side wall of the groove is recessed along a reverse direction of an opening of the groove to form the guide groove of the lamp;

in the two adjacent lamps, after the guide member of the first lamp is in inserted connection to the guide groove of the second lamp, the stop wall of the first lamp is in inserted connection into the groove of the second lamp, and a bottom surface of the first lamp and a bottom surface of the second lamp are positioned on a same plane; and the guide member is a guide column.

5. The assembled lamp according to claim 1, wherein the lamp has four side walls, wherein the first conductive terminal is arranged on one of the four side walls, the row holes are disposed on other three side walls of the four side walls, and the second guide terminal is arranged in the row hole.

6. The assembled lamp according to claim 1, wherein a top surface and a bottom surface are respectively disposed at both ends of the side wall of the lamp; and the top surface includes a light homogenization plate, and light emitted by the light source device inside the lamp uniformly emerges through the light homogenization plate.

7. The assembled lamp according to claim 6, wherein a capacitance sensor is arranged on the light homogenization plate, the capacitance sensor is connected with the light source device inside the lamp, and when sensing a capacitance generated by a user, the capacitance sensor controls the light source device to emit light.

8. The assembled lamp according to claim 1, wherein each of the first conductive terminal and the second conductive terminal includes at least two terminals, wherein the at least two terminals include a positive end and a negative end, the positive end and the negative end are respectively and correspondingly connected with a positive end and a negative end of the power supply bus inside the lamp, and a terminal at the positive end is connected with the communication bus inside the lamp and connected with the processor of the lamp via the communication bus; and after the two adjacent lamps are in inserted connection through the first conductive terminal and the row hole, the first conductive terminal is connected with a terminal with a corresponding function in the second conductive terminal in the row hole.

9. The assembled lamp according to claim 8, wherein each of the first conductive terminal and the second conductive terminal includes four terminals, the four terminals include:

two power supply terminals including a positive end terminal and a negative end terminal, and the positive end terminal and the negative end terminal are respectively and correspondingly connected with the positive end and the negative end of the power supply bus inside the lamp;

one communication terminal, connected with the communication bus inside the lamp and connected with the processor of the lamp via the communication bus; and one identification terminal, configured to identify the lamp connected with the one identification terminal, and the external main controller configures address information to the lamp connected with the identification terminal by the identification terminal identifying the lamp.

10. The assembled lamp according to claim 1, wherein the lamp internally further includes:

a voltage reduction module, one end of the voltage reduction module being connected with the power supply bus and the other end of the voltage reduction module being connected with the processor, the voltage reduction module receiving the external voltage signal through the power supply bus, stabilizing the external voltage signal to a preset voltage value and transmitting the external voltage signal to the processor so as to provide a working voltage for the processor; and a drive module, respectively connected with the processor and the light source device in the lamp, after receiving the control signal by utilizing the communication bus and processing the control signal, the processor transmitting the processed control signal to the drive module, and the drive module generating a corresponding drive signal according to the processed control signal so as to control a light-emitting state of the light source device.

11. The assembled lamp according to claim 1, wherein the processor includes a single chip microcomputer; and the control signal includes: a signal for controlling anyone of the lamps to emit light or be turned off; and/or a signal for carrying out dimming control and/or color modulation control on anyone of the lamps, wherein a type of the control signal includes a digital signal type.

12. The assembled lamp according to claim 1, wherein magnet members are arranged on both the first conductive terminal and the second conductive terminal, or the first conductive terminal and the second conductive terminal have magnetism; and after the first conductive terminal of the first lamp is inserted into the row hole of the second lamp with the second conductive terminal, the first conductive terminal and the second conductive terminal absorb through the respective magnet members or absorb mutually through the respective magnetism so as to implement mechanical connection between the two adjacent lamps.

13. A lighting system, comprising: a main controller and the assembled lamp connected with the main controller according to claim 1, wherein a first conductive terminal or a row hole in which a second conductive terminal is arranged is arranged at any one end of the main controller, the main controller internally includes a control module for generating a control signal and a communication bus and a power supply bus which are respectively connected with the control module, and each of the power supply bus and the communication bus is connected with the first conductive terminal or the second conductive terminal on the main controller;

the first conductive terminal of the main controller is inserted into the row hole of any one of the lamps and connected with the second conductive terminal in the row hole; or the first conductive terminal of any one of the lamps is inserted into the row hole of the main controller and connected with the second conductive terminal in the row hole, so as to implement mechanical connection, electrical connection and communication connection between the main controller and the assembled lamp;

the power supply bus of the main controller receives an external voltage signal, supplies power to the control module inside, transmits the external voltage signal to a power supply bus of each of the lamps in the assembled lamp via the conductive terminal in inserted connection with the main controller, and supplies power to the processor and the light source device inside each of the lamps; and the control module of the main controller generates a control signal and transmits the control signal onto the communication bus of each of the lamps in the assembled lamp via the conductive terminal in inserted connection with the main controller, and the processor of at least one of the lamps controls a light-emitting state of the light source device inside of the lamp by utilizing the control signal on the communication bus.

14. The lighting system according to claim 13, wherein the main controller is provided with a guide member positioned on a same lateral surface with the first conductive terminal and corresponding to a guide groove of the lamp, the guide member is in inserted connection with the guide groove of any one of the lamps; or the main controller is provided with a guide groove positioned on a same lateral surface with the row hole and corresponding to a guide member of the lamp, the guide groove is in inserted connection with the guide member of any one of the lamps.

15. The lighting system according to claim 14, wherein a stop wall corresponding to a groove of the lamp is arranged on a side of the first conductive terminal of the main controller, a side of the stop wall facing away the first conductive terminal and a bottom surface of the main controller are positioned on a same plane, a thickness of the stop wall is equal to a depth of the groove of the lamp, both ends of the stop wall extend in a direction which is perpendicular to the stop wall and towards the first conductive terminal to form convex edges, and the guide member of the main controller is arranged at a top of the convex edge; the stop wall of the main controller is in inserted connection into the groove of any one of the lamps, and a bottom surface of the main controller and a bottom surface of the lamp are positioned on a same plane; or a groove corresponding to a stop wall of the lamp is disposed on a side of the row hole of the main controller, a depth of the groove is equal to a thickness of the stop wall of the lamp, and a side wall of the groove is recessed along a reverse direction of an opening of the groove to form the guide groove of the lamp; and the stop wall of any one of the lamps is in inserted connection into the groove of the main controller, and the bottom surface of the lamp and the bottom surface of the main controller are positioned on a same plane.

16. The lighting system according to claim 13, wherein the first conductive terminal or the second conductive terminal of the main controller includes at least two terminals, and correspondingly, each of the first conductive terminal and the second conductive terminal of the lamp includes at least two terminals, wherein the at least two terminals in the conductive terminal of the lamp include a positive end and a negative end, the positive end and the negative end are respectively and correspondingly connected with a positive end and a negative end of the power supply bus inside the lamp, and a terminal at the positive end is connected with the communication bus inside the lamp and connected with the processor of the lamp via the communication bus; and the at least two terminals in the conductive terminal of the main controller include a positive end and a negative end, the positive end and the negative end are respectively and correspondingly connected with a positive end and a negative end of the power supply bus inside the main controller, and a terminal at the positive end is connected with the control module of the main controller; and after the main controller is connected with the assembled lamp through the conductive terminals, the terminals with the corresponding functions are connected with each other.

17. The lighting system according to claim 16, wherein each of the first conductive terminal and the second conductive terminal of the lamp includes four terminals, the four terminals include two power supply terminals, one communication terminal and one identification terminal, wherein in the conductive terminal of the lamp, the two power supply terminals include a positive end terminal and a negative end terminal, and the positive end terminal and the negative end terminal are correspondingly connected with the positive end and the negative end of the power supply bus inside the lamp; the one communication terminal is connected with the communication bus inside the lamp and connected with the processor of the lamp via the communication bus; the one identification terminal is used for identifying the lamp connected with the identification terminal, and the main controller configures address information to the lamp connected with the identification terminal by the identification terminal for identifying the lamp;

the conductive terminal of the main controller includes four terminals, wherein two power supply terminals include a positive end terminal and a negative end terminal, and the positive end terminal and the negative end terminal are correspondingly connected with the positive end and the negative end of the power supply bus inside the main controller; one communication terminal and one identification terminal are respectively connected with the control module of the main controller; and after the main controller is connected with the assembled lamp through the conductive terminals, the terminals with the corresponding functions are connected with each other.

18. The lighting system according to claim 13, wherein a magnet member is arranged on the first conductive terminal or the second conductive terminal of the main controller, and corresponding magnet members are also arranged on the first conductive terminal and the second conductive terminal of the lamp; after the first conductive terminal of the main controller is inserted into the row hole of the lamp, or the first conductive terminal of the lamp is inserted into the row hole of the main controller, the first conductive terminal and the second conductive terminal connected with each other absorb mutually by the respective magnet members so as to implement mechanical connection between the main controller and the lamp; or the first conductive terminal or the second conductive terminal of the main controller has magnetism, and the first conductive terminal and the second conductive terminal of the lamp have magnetism; and after the first conductive terminal of the main controller is inserted into the row hole of the lamp, or the first conductive terminal of the lamp is inserted into the row hole of the main controller, the first conductive terminal and the second conductive terminal connected with each other absorb mutually through the respective magnetism so as to implement mechanical connection between the main controller and the lamp.

19. The lighting system according to claim 13, wherein the control module of the main controller generates a control signal, and transmits the control signal onto the communication bus of each of the lamps in the assembled lamp on the basis of a customized transmission protocol by utilizing the conductive terminal in inserted connection with the main controller.

* * * * *